United States Patent [19]

Nussbaum

[11] Patent Number: 4,651,649

[45] Date of Patent: Mar. 24, 1987

[54] SABOT FOR SUBCALIBER PROJECTILES

[76] Inventor: Helmut Nussbaum, Kammerwaldstrasse 21, 5529 Bauler, Fed. Rep. of Germany

[21] Appl. No.: 707,693

[22] Filed: Mar. 4, 1985

[51] Int. Cl.[4] ..... F42B 13/16

[52] U.S. Cl. ..... 102/521

[58] Field of Search ..... 102/520–523, 102/532

[56] References Cited

U.S. PATENT DOCUMENTS 3,496,869 2/1970 Engel ..... 102/522

4,542,696 9/1985 Bisping et al. ..... 102/523

*Primary Examiner*—Harold J. Tudor

*Attorney, Agent, or Firm*—Antonelli, Terry & Wands

[57] ABSTRACT

A sabot for propelling subcaliber projectiles in gun barrels, with the projectile being annularly surrounded by the sabot. The sabot, as viewed circumferentially, is shaped as at least a two part substantially cylindrical jacket provided with an annular flange disposed in a forward end thereof, which annular flange serves as a reinforcing and sealing plate. A further annular flange is provided in an area of the rear end of the cylindrical jacket, with a space between the two flanges being at least partially filled with hollow fibers made of, for example, glass, carbon, or the like, with the space extending from the outer edge of the sealing plate to the rear annular flange. The fibers are embedded in a matrix composed of, for example, a plastic material or an alloy.

30 Claims, 3 Drawing Figures

SABOT FOR SUBCALIBER PROJECTILES

The present invention relates to a sabot for propelling subcaliber projectiles in gun barrels, wherein the projectile is annularly surrounded by the sabot.

Sabots for firing subcaliber projectiles have been proposed, with the sabots being disposed as plugs of the same caliber behind the subcaliber projectile and separating very rapidly from the projectile after the projectile leaves the barrel, that is, the sabots lag behind the projectiles and fall harmlessly to the ground at a relatively short distance from the mouth of the barrell. To provide a good and adequate guidance in the barrell, the rear of the projectile can also be inserted more or less deeply in a matching recess on a forward end face of the sabot, whereby the sabot is then fashioned of a material that breaks easily upon leaving the barrell or is composed of a plurality of circumferentially arranged parts.

A sabot has also been proposed which is in the form of a tubular body, with the tubular body surrounding a portion of an axial length of the projectile. The sabot includes at least two parts, when viewed in a circumferential direction, so the sabot or its parts separate readily from the projectile and drop away therefrom after the projectile leaves the barrel. In order to economize on both material used and weight, as well as to avoid unnecessarily high resistance as the sabot passes through the barrel, the sabot is usually cut away at its circumference in a middle area thereof, so that only the forward and rear guide ring, of a predetermined width, are of the correct cabilber. The width of the guide ring is, as a rule, dimensioned so that the guide ring can both withstand the pressure of the propellant gases without deforming as well as ensure a tight fit in the barrel, in the grooves and lands if any.

By virtue of the reduction of the weight of the sabot, it is possible to permit a higher projectile velocity and/or a higher projectile weight thereby improving the overall effect on the target for kinetic energy projectiles. It is also possible to take into account that a material with a high unit weight as opposed to a lower unit weight can be used; however, there are strict restrictions on weight reduction by material replacement because most lighter materials are not or are only insufficiently capable of withstanding the high stresses that develop under these conditions.

The aim underlying the present invention essentially resides in providing a sabot for propelling subcaliber projectiles which considerably reduces the weight of the sabot surrounding the projectile and which seals the subcaliber projectiles while ensuring a sufficient resistance to the high pressures which develop.

In accordance with advantageous features of the present invention, the sabot surrounding the projectile is fashioned of an at least two part, as viewed in a circumferential direction, substantially cylindrical jacket, with an annular flange having a reinforcement function being disposed in a vicinity of a forward end thereof and being constructed as a sealing plate. An annular flange is provided in a vicinity of the rear end of the sabot and a space between the two flanges is at least partially filled with hollow fibers of, for example, glass, carbon, or the like, extending up to the rear annular flange, with the fibers being embedded in a matrix made of, for example, plastic or an alloy.

Advantageously, in accordance with the present invention, the hollow fibers are embedded in the matrix in such a manner so as to be exposed to substantially equal pressures on all sides thereof.

The rear annular flange may be provided with axially extending openings and a space remaining between the two flanges may be filled at least partially with a powder. The annular flange forming the sealing plate may be provided at its rear face with a lining made of a high strength material such as, for example, a spring steel sheet, with the lining being provided with an extension surrounding an outer circumference of the annular flange forming the sealing plate. Additionally, the lining may be provided with an extension portion which surrounds the jacket over at least a portion of its axial length and, for example, may be extended up to a rear face of the annular flange provided at the rear end of the sabot and at least partially flangewise extend over the rear annular flange.

The lining may, in accordance with the present invention, be provided with recesses in a vicinity of the annular flange forming the sealing plate and/or the cylindrical jacket and/or the rear annular flange. The annular flange forming the sealing plate or the lining surrounding the sealing plate may include, at its outer circumference, a guide ring of a matching caliber, with the guide ring being constructed as a separate or independent component. Advantageously, the guide ring merges into a cap member made of, for example, a plastic material, and overlaps a forward end of the projectile, with the cap having at least two breakage or rupture lines preferably uniformly distributed about the circumference extending from the tip to the rear end of the guide ring.

The cap advantageously abuts the projectile body by a plurality of internal ribs, with the ribs being preferably distributed uniformly about the circumference thereof.

In accordance with still further features of the present invention, the hollow fiber reinforced matrix may be connected by pins or similar fastening elements at least with the annular flange forming the sealing plate of the cylindrical jacket, with the hollow fiber reinforcing matrix being connected to the guide ring by pins or similar fastening elements.

The lining associated with the annular flange forming the sealing plate fits into recesses in the cylindrical jacket, with the sealing plate being connected to the projectile body by means of projections and notches.

Preferably, the rear annular flange is constructed as a guide ring, and the projectile is held in sealing fashion in a mouth of a cartridge shell by the rear annular flange of the cylindrical jacket.

Accordingly, it is an object of the present invention to provide a sabot for propelling subcaliber projectiles which avoids, by simple means, shortcomings and disadvantages encountered in the prior art.

Another object of the present invention resides in providing a sabot for propelling subcaliber projectiles which is simple in construction and therefore relatively inexpensive to manufacture.

Yet another object of the present invention resides in providing a sabot for propelling subcaliber projectiles which enables the attainment of a higher projectile velocity so as to significantly improve the effect on the target for kinetic energy projectiles.

A still further object of the present invention resides in providing a sabot for propelling subcaliber projectiles which enables the use of a higher projectile weight.

These and other objects, features, and advantages of the present invention will become more apparent from the following description when taken in connection with the accompanying drawings which show, for the purpose of illustration only, the embodiments of the present invention.

Figure 1:
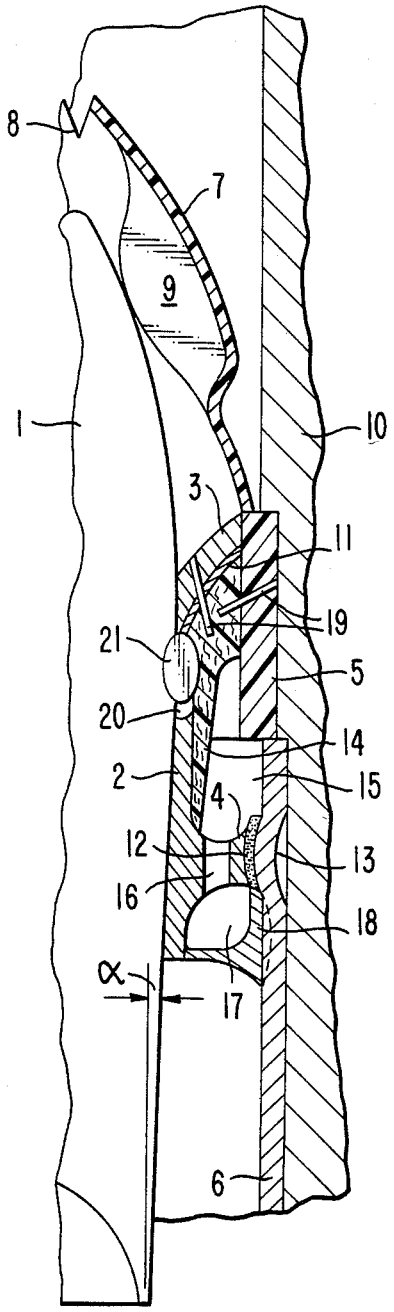
FIG. 1 is a schematic partial cross sectional view of a sabot for subcaliber projectiles constructed in accordance with one embodiment of the present invention.

Referring now to FIG. 1 of the drawings, according to this figure, a subcaliber projectile 1 is surrounded by a substantially cylindrical jacket 2 made of, for example, an alloy such as cast aluminum, with the cylindrical jacket 2 having, at a forward end thereof, an annular flange 3 having a reinforcement function and serving as a sealing plate and, at a rear end thereof, an annular flange 4. This annular flange 4 is fitted externally to bead 13 on shell 6. An outer edge of the annular flange 3 forming the sealing plate abuts a guide ring 5, with the guide ring 5 having an axial length such that a rear end portion thereof extends up to a mouth of a cartridge shell 6.

A cap 7 abuts a forward end of the guide ring 5, with the cap having a fracture or rupture point 8 at a tip portion thereof. Fracture or rupture lines extend from the fracture or rupture point 8 in a manner not shown up to a rear end of the guide ring 5. The cap 7 is supported against the projectile body 1 by a plurality of ribs 9 preferably uniformly disposed about a circumference thereof. The projectile 1 and the sabot is disposed in a gun barrel 10, with the guide ring 5 being pressed into grooves in the gun barrel 10.

Figure 2:
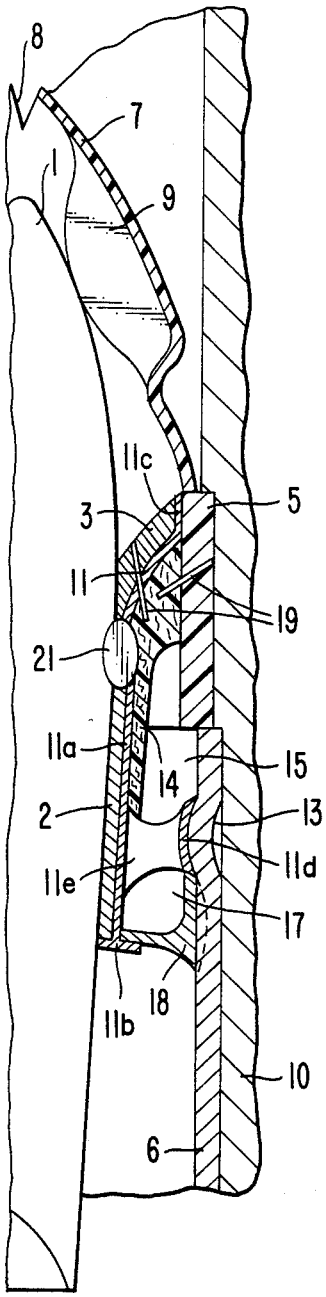
FIG. 2 is a schematic partial cross-sectional view of a sabot for subcaliber projectiles constructed in accordance with a second embodiment of the present invention.
Figure 3:
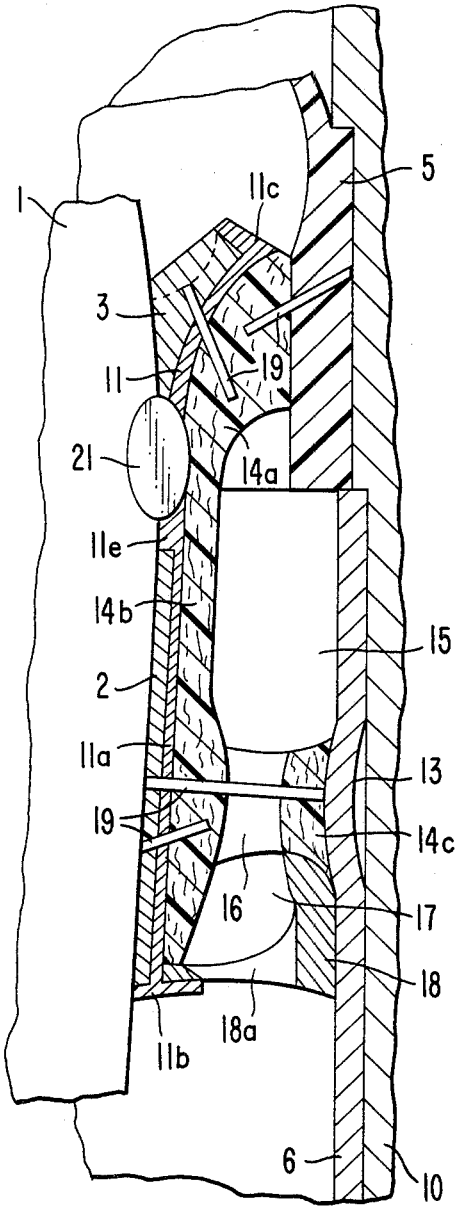
FIG. 3 is a schematic partial cross-sectional view of a sabot for subcaliber projectiles constructed in accordance with a third embodiment of the present invention.

A ring or lining 11, extending over the entire circumference of the sabot, is disposed at a rear face of the annular flange 3 forming the sealing plate, with the ring or lining 11 being made of, for example, a high strength material such as, for example, spring steel sheet, thereby serving to stiffen or reinforce the annular flange 3 forming the sealing plate. To provide an additional reinforcement or stiffening and to increase a load capacity of the annular flange 3 forming the sealing plate as well as to improve the transmission of force to the subcaliber projectile 1 to be accelerated as shown in FIG. 2 and FIG. 3, the ring or lining 11 may be provided with a substantially cylindrical extension **11*c* fitting around an exterior of the annular flange 3 forming the sealing plate and/or an extension 11*c* which surrounds the cylindrical jacket 2 for at least a portion of an axial length thereof. In the embodiment of FIG. 3 the extension 11*c* is shown fitting over the annular flange 3 frustoconically. The extension surrounding the cylindrical jacket 2 may also extend up to the rear face of the annular flange 4 so as to form and extension 11*b*** which overlaps the annular flange at least partially flangewise.

The ring or lining 11 as well as the cylindrical jacket 2 and the annular flange 3 forming the sealing plate is, as viewed in a circumferential direction, fashioned of two or three parts. As seen in FIG. 2, if the ring or lining **11*a* is to extend over the entire circumference up to the rear face of the annular flange 4, through holes or openings 11*e* are provided in the ring or lining 11*a* in a vicinity or area of the annular flange 4 through which holes or openings 11*e* the material to form the annular flange 4 can pass during a manufacturing of the sabot, with the sabot being, for example, prefabricated by stamping, casting or extruding. Also, in place of annular flange 4, an annular flange 11*d* externally fitted to bead 13 on shell 6 can be formed on extension 11*a*. Additional openings or recesses in the ring or lining 11 can be provided in a vicinity of the cylindrical jacket 2 and/or the annular flange 3 forming the sealing plate whereby the openings or recesses can serve either to not only reduce the weight but also improve the anchoring of the sabot to the ring or lining 11. By virtue of the annular flange 4, the sabot is held firmly in the mouth of the cartridge shell by using, for example, a sealing material shown as 12** in FIG. 1.

In FIG. 1, there is shown a space between a cylindrical jacket 2, the annular flange 3, the ring or lining 11, and the annular flange 4, and between the guide ring 5 and cartridge shell 6, a space located behind the jacket 2 and the annular flange 3 being filled with a hollow-fiber reinforced matrix 14. In FIG. 3, the hollow-fiber reinforced matrix is designated **14*a* and 14*b*, the forward part 14*a* being thicker to provide high strength. In this embodiment the annular flange 3 need not be brought up to guide ring 5 but can be a more or less considerable distance therefrom. In this case annular flange 14*c* is fitted externally to bead 13 of sleeve 6 formed in area 14*b* on the matrix. In the embodiment of FIGS. 1–3, space 15 is filled with a powder (not shown), with openings 16 being provided in the annular flange 4 of FIG. 1 or 14*c* of FIG. 3 or openings 11*e* being provided in annular flange 11*d* of FIG. 2 to permit ignition upon a firing. As can be appreciated, the opening 16 in FIG. 1 or 3 or 11*e* in FIG. 2 as well as a space 17 in FIGS. 1–3 and 18*e* in FIG. 3 disposed behind the rear face of the annular flange 4 in FIG. 1, 11*d* in FIG. 2 or 14*c*** in FIG. 3 could be filled with powder as well if advantageous or necessary. The embedding of the hollow fibers in the matrix creates spaces or voids while simultaneously serving to reinforce the matrix. The hollow fibers have a high strength and sufficient stiffness and are used in a ratio of the wall thickness to the diameter so that it is sufficient to withstand the pressure of the propellant gases in each individual case.

The hollow fiber reinforced matrix is disposed in the space 15 so that it is exposed to omnilateral pressure of a practically constant magnitude, that is, a hydraulic pressure, so that no gradients of the tensile and shearing forces can develop in the space 15 which could lead to the separation of the material. The embedded hollow fibers are preferably disposed longitudinally so that the fibers reinforce the function of the annular flange 3 forming the sealing plate against the pressure of the propellant gases, that is, they counteract any bending of an outer edge of the annular flange 3 forming the sealing plate in a direction of the mount of the gun barrel 10.

A sealing ring 18 is provided between the cylindrical jacket 2 and the cartridge shell 6 at a rear of the cylindrical jacket 2, with the sealing ring 18 forming the space 17 together with the cylindrical jacket 2 and the annular flange 4. The sealing ring 18 is advantageously provided in situations wherein both spaces 15, 17 are completely filled with the hollow fiber reinforced matrix. As can be seen in FIG. 3, sealing ring 18 may be provided with opening **18*a***.

To provide a reliable and solid connection of the annular flange 3 forming the sealing plate to the ring or lining 11 and the hollow fiber reinforced matrix as well as for a corresponding connection between the hollow fiber reinforced matrix and the guide ring 5, pin-shaped connecting elements 19 are provided, with the elements 19 being shaped, for example, as steel pins. However, as can well be appreciated, the elements 19 may have a different configuration in dependence upon a particular application. As can be seen in FIG. 3, additional pin-shaped connecting elements may be provided in the vicinity of annular flange 14*c*.

The ring or lining 11 engages matching depressions in the cylindrical jacket 2, with a plurality of tongue-shaped extensions 20 disposed around a circumference thereof, whereby wing-like shapes 21, formed on the projectile, simultaneously engage matching recesses and extensions 20 of the ring 12 thereby locking the elements together. As can be seen in FIG. 3, a thickened area 11*e* can be provided for engaging a matching recess in part 2 for improved mutual anchoring.

In the illustrated embodiment, the projectile 1 is provided with an ogive or pointed arch at a forward end thereof and a conical taper at a rear end thereof. The taper of the projectile 1, determined by the angle $\alpha$ and the consequent shape of the cylindrical jacket 2 creates a situation in which the entire sabot is pressed tightly into the annular space between the projectile 1 and an upper inside wall by the pressure of the propellant gases when the gun is fired, which space tapers in a wedge shape forward where the sabot is firmly held. However, as can readily be appreciated, the projectile 1 could also have another suitable form wherein, for example, a diameter is provided which remains constant over an entire length thereof. In this connection, it is merely necessary to proceed, in a conventional manner, using annular ribs and grooves of appropriate other connecting and fastening elements to ensure a realiable and secure connection between the projectile 1 and the sabot or the cylindrical jacket 2 of the sabot which will withstand the pressure of the propellant gases.

Regardless of whether the tip of the projectile is designed as a pointed arch or ogive, the cap 7 may be eliminated, although the cap is advantageous for a realiable feed in a magazine of a weapon when the projectile 1 is fired from automatic weapons. If the cap 7 is eliminated, the guide ring 5 can either only be crimped over the outer circumference of the annular flange 3 forming the sealing plate or may be connected to the latter as well. The cap 7 together with the ribs 9 and guide ring 5 are preferably made of, for example, a thermal plastic material such as, for example, a polyamide or the like.

In each individual case, that is, depending upon the size and construction of the projectile 1 or the weapon designed to fire it, the sabot can of course extend over a larger or smaller portion of an axial length of the projectile 1. Thus, the space 15 can be made longer or shorter or a part of the cylindrical jacket that extends over the rear annular flange can either be extended or even entirely omitted. As can be appreciated, the subject matter of the present invention is not limited to cartridge ammunition but, on the contrary, provision can be made to introduce the projectile with the sabot and guide ring directly into a gun barrel and dispose behind it a separate cartridge containing a propellant charge.

Additionally, a smooth barrel can also be used for firing and, for example, the sabot may be surrounded by a catridge over its entire length whereby the guide ring can be eliminated.

While I have shown and described only one embodiment in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A sabot for propelling a subcaliber projectile in a gun barrel, the sabot being annularly shaped and surrounding the projectile, the sabot includes a cylindrical jacket circumferentially divided into at least two parts, a first annular flange means is provided in an area of a forward end of the cylindrical jacket, a second annular flange means is provided at a rear end of the cylindrical jacket, a space is defined between the first and second annular flange means, with the space extending from an outer edge of the first flange means to the second flange means, and hollow fibers are disposed in the space to at least partially fill the same, said hollow fibers being embedded in a matrix.

2. A sabot according to claim 1, wherein said hollow fibers are at least one of glass and carbon fibers.

3. A sabot according to claim 2, wherein the matrix is formed of at least one of an alloy and a plastic material.

4. A sabot according to claim 3, wherein the hollow fibers are embedded in the matrix in such a manner so as to be exposed to substantially equal pressure on all sides thereof.

5. A sabot according to claim 4, wherein axially extending openings are provided in the second flange means, and wherein a powder at least partially fills a remaining portion of the space between the first and second annular flange means.

6. A sabot according to claim 5, further comprising a lining means provided along a rear face of the first annular flange means for reinforcing the same.

7. A sabot according to claim 6, wherein said lining means is formed of a spring steel sheet.

8. A sabot according to claim 6, wherein the lining means includes an extension portion surrounding an outer circumference of the first annular flange means.

9. A sabot according to claim 8, wherein the lining means includes a further extension portion surrounding at least a portion of the cylindrical jacket.

10. A sabot according to claim 9, wherein the lining means extends up to a rear face of the second annular flange means and fits over the same.

11. A sabot according to claim 10, wherein the lining means is provided with a plurality of recesses in an area of at least one of the first annular flange means, cylindrical jacket, and the second annular flange means.

12. A sabot according to claim 11, wherein one of the first annular flange means and the lining means includes a guide ring of a matching caliber.

13. A sabot according to claim 12, wherein said guide ring is fashioned as a separate component and is mounted on one of the first annular flange means and the lining means.

14. A sabot according to claim 13, wherein a cap means is provided for overlapping a forward end of the projectile, said guide ring merges into said cap means, and wherein said cap means includes at least two circumferentially uniformly spaced fracture lines extending from a tip of the cap means to a rear end of the guide ring.

15. A sabot according to claim 14, wherein said cap means is formed of a plastic material.

16. A sabot according to claim 14, wherein said cap means includes a plurality of uniformly distributed circumferentially spaced rib means abutting the projectile for supporting the cap means at the projectile.

17. A sabot according to claim 16, wherein means are provided for connecting said matrix with at least the first annular flange means of the cylindrical jacket.

18. A sabot according to claim 17, wherein means are provided for connecting the matrix to the guide ring.

19. A sabot according to claim 18, wherein said means for connecting the matrix to the first annular flange means and to the guide ring include a plurality of pins.

20. A sabot according to claim 17, wherein the cylindrical jacket includes a recess means for accommodating the lining means.

21. A sabot according to claim 20, wherein notch means and projection means are provided for connecting the first annular flange means to a body of the projectile.

22. A sabot according to claim 21, wherein said second annular flange means is a guide ring.

23. A sabot according to claim 21, wherein said second annular flange means is adapted to hold the projectile in a sealing manner in a mouth of a cartridge shell.

24. A sabot according to claim 1, wherein axially extending openings are provided in the second flange means, and wherein a powder at least partially fills a remaining portion of the space beteen the first and second annular flange means.

25. A sabot according to claim 1, further comprising a lining means provided along a rear face of the first annular flange means for reinforcing the same.

26. A sabot according to claim 25, wherein one of the first annular flange means and the lining means includes a guide ring of a matching caliber.

27. A sabot according to claim 1, wherein a cap means is provided for overlapping a forward end of the projectile, said guide ring merges into said cap means, and wherein said cap means includes at least two circumferentially uniformly spaced fracture lines extending from a tip of the cap means to a rear end of the guide ring.

28. A sabot according to claim 27, wherein said cap means includes a plurality of uniformly distributed circumferentially spaced rib means abutting the projectile for supporting the cap means at the projectile.

29. A sabot according to claim 1, wherein means are provided for connecting said matrix with at least the first annular flange means of the cylindrical jacket.

30. A sabot according to claim 1, wherein means are provided for connecting the matrix to the guide ring.

* * * * *